United States Patent [19]

MacDonald

[11] Patent Number: 4,579,522

[45] Date of Patent: Apr. 1, 1986

[54] FLARE STACK IGNITOR

[76] Inventor: Roderick J. MacDonald, 303 - 17B Niven St., Red Deer, Alberta, Canada

[21] Appl. No.: 466,665

[22] Filed: Feb. 15, 1983

[30] Foreign Application Priority Data

Oct. 7, 1982 [CA] Canada ..... 413042

[51] Int. Cl.[4] ..... F23D 13/20

[52] U.S. Cl. ..... 431/202; 431/258; 187/95

[58] Field of Search ..... 431/5, 202, 258, 264, 431/263; 187/8, 95; 126/25 B; 60/39.5; 313/356, 122

[56] References Cited

U.S. PATENT DOCUMENTS

| | | | |
|---|---|---|---|
| 1,041,020 | 10/1912 | Carstens | 187/95 |
| 1,279,974 | 9/1918 | Blomster et al. | 313/122 |
| 2,493,743 | 1/1950 | Benson | 431/263 |
| 3,558,251 | 2/1971 | Bauger et al. | 431/266 |
| 3,699,383 | 10/1972 | Chaney | 313/618 |
| 3,908,801 | 9/1975 | Pohlman | 187/8 |
| 4,147,493 | 4/1979 | Straitz | 431/202 |

*Primary Examiner*—Samuel Scott
*Assistant Examiner*—Noah Kamen
*Attorney, Agent, or Firm*—William R. Hinds; George H. Dunsmuir

[57] ABSTRACT

Flare stack ignitors are normally permanent structures, the principle components of which are inaccessible from the ground. By mounting the probes and the associated transformer on trolleys, and providing tracks for such trolleys along substantially the entire length of the flare stack, the ignitor is relatively easy to maintain. Hollow probes ensure that a good supply of oxygen is drawn into the combustion area.

2 Claims, 6 Drawing Figures

FLARE STACK IGNITOR

BACKGROUND OF THE INVENTION

This invention relates to a flare stack ignitor, and in particular to a remote control flare stack ignitor.

Ignitors for so-called flare or vent stacks must ensure ignition and maintain combustion of gases emitted from the stacks. Moreover, it should be a simple matter to install and service such ignitors. Flare stack ignitors are disclosed by, for example U.S. Pat. Nos. 3,797,991, issued to J. F. Straitz, III on Mar. 19, 1974; 3,833,336, issued to W. L. Ray on Sept. 3, 1974; and 4,147,498, issued to R. R. Clarke on Apr. 3, 1979. The ignitors disclosed by these patents are permanently installed on flare stacks, and thus maintenance is unnecessarily complicated. In order to service the ignitor, disassembly of the stack, or alternatively a climb to the top of the stack is required.

OBJECTS OF THE INVENTION

An object of the present invention is to provide a relatively simple flare stack ignitor, the principle elements of which can be readily displaced from the aperture position at the top of the flare stack, to the bottom of the stack for ease of access.

Another object of the invention is to provide an electrode structure for use in a flare stack ignitor which ensures ignition of gas even under adverse conditions.

SUMMARY OF THE INVENTION

Accordingly, the present invention relates to a flare stack ignitor for igniting gas emitted from a flare stack comprising track means for mounting on a flare stack; trolley means movably mounted on said track means for movement between a rest position at the bottom of the stack and an ignition position at the top of said stack; drive means for moving said trolley means between the rest and ignition positions; probe means carried by said trolley means for igniting said gas; and power means for providing electrical power to said probe means for causing arcing, and consequently ignition of said gas.

The invention also relates to a probe for use in a flare stack ignitor of the type including a source of electrical power for causing arcing between a pair of probes whereby any combustible gas passing between said probes is ignited, said probe comprising an elongated, hollow, electrically conductive body for conducting electric current, said body including an inlet end for admitting air into the body and a discharge end for discharging air into the gas, whereby the flow of said gas draws air through the body for promoting combustion of said gas.

BRIEF DESCRIPTION OF THE DRAWINGS

The invention will now be described in greater detail with reference to the accompanying drawings which illustrate a preferred embodiment of the invention, and wherein.

DESCRIPTION OF THE PREFERRED EMBODIMENT(S)

Figure 3:
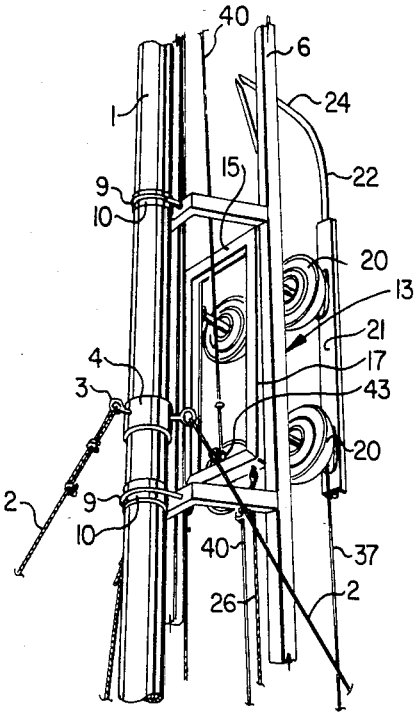
FIG. 3 is a perspective view from below of the probe structure used in the device of FIGS. 1 and 2.

With reference to the drawings, the flare stack ignitor of the present invention is intended for use on a tubular flare stack 1 of the type normally used to dishcharge sour gas from a well (not shown). The flare stack is maintained in the vertical position by guy wires 2 (FIG. 3), the top ends of which are connected to eyes 3 extending outwardly from a sleeve 4 on the stack 1, and the bottom ends of which are connected to ground anchors (not shown). Sour gas is discharged from the top end 5 of the stack 1, and is ignited by the ignitor of the present invention.

Figure 1:
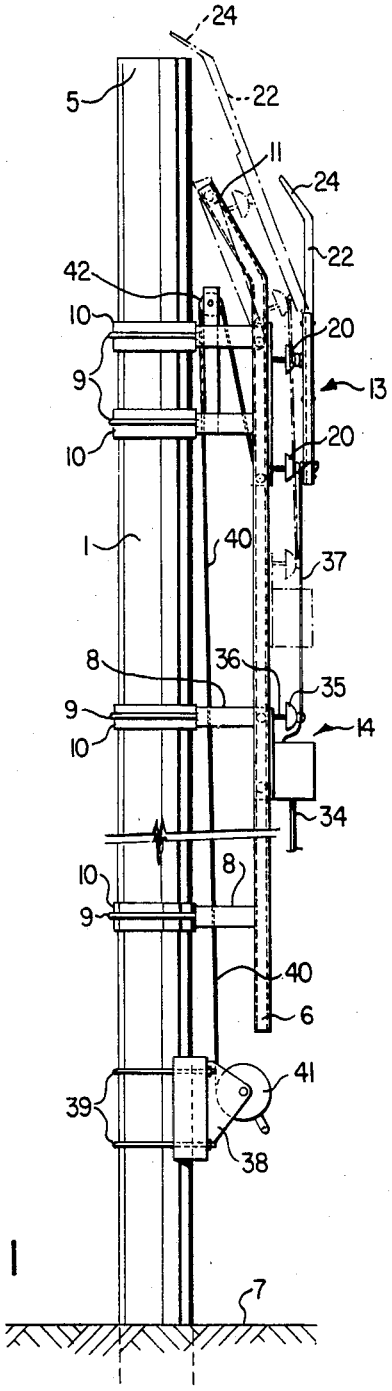
FIG. 1 is a side elevation view of a flare stack and ignitor in accordance with the present invention.
Figure 2:
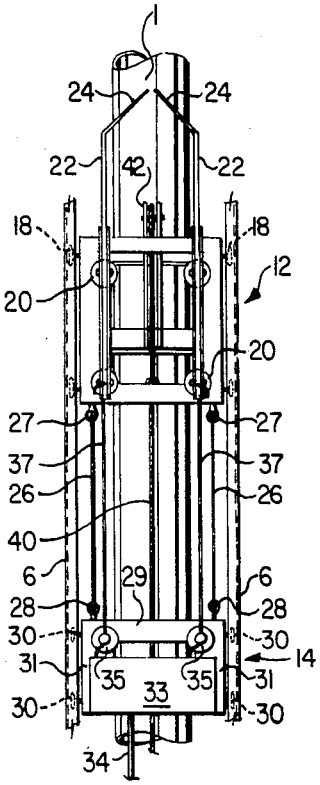
FIG. 2 is a front elevation view of the main elements of the ignitor of FIG. 1.
Figure 4:
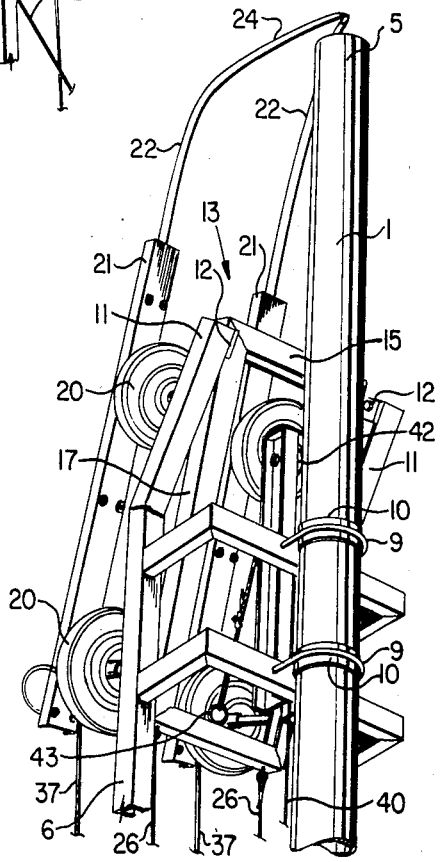
FIG. 4 is a perspective view from below of the probe structure of FIG. 3 in the igniting position.

The ignitor of the present invention can be permanently installed on new stacks during installation, or alternatively added to an existing stack. The ignitor includes a pair of parallel tracks 6 extending upwardly from close to the ground 7 to close to the top 5 of the stack 1. The tracks 6 are connected to the stack by generally U-shaped arms 8, which are integral with the tracks 6, and U-bolts 9, which connect the arms 8 to the stack 1. The bolts 9 are insulated from the stack 1 by means of nonconductive sleeves 10. The tracks 6 have a generally U-shaped cross section, the open sides thereof opposing each other, i.e. facing inwardly. As best shown in FIGS. 1 and 4, the upper ends 11 of the tracks 6 are bent inwardly towards the stack 1, and a stop plate 12 is provided at the top end of each track.

The tracks 6 movably support a pair of carriages, generally indicated at 13 and 14. The uppermost carriage 13 is defined by a rectangular frame 15. A pair of stub axles 16 extend outwardly from each side 17 of the frame 15 for supporting discs 18. The use of discs 18 rather than rollers reduces maintenance of the ignitor, since there are no bearings to corrode. The discs 18 ride in the tracks 6. The spacing between the tracks 6 is only slightly greater than the width of the frame 15, so that, once inserted from the bottom end, the frame 15 is retained between the tracks. Four posts 19 extend outwardly from the sides 17 of the frame 15 (when the trolley is in the vertical position). Bell-shaped insulators 20 are mounted on the outer ends of the posts 19. The insulators 20 are high voltage, high gloss insulators which prevent shorting out because of carbon build-up or possible oil splash. The insulators 20 support a pair of elongated probe supports 21. The probe supports are parallel to each other, and parallel to the sides 16 of the trolley frame 15. The probe supports have a generally U-cross-sectional configuration. A probe 22 is mounted in each of the supports 21. The probe 22, which may be in solid bar form or hollow tube, is held in the support by a plurality of U-bolts 23.

Figure 5:
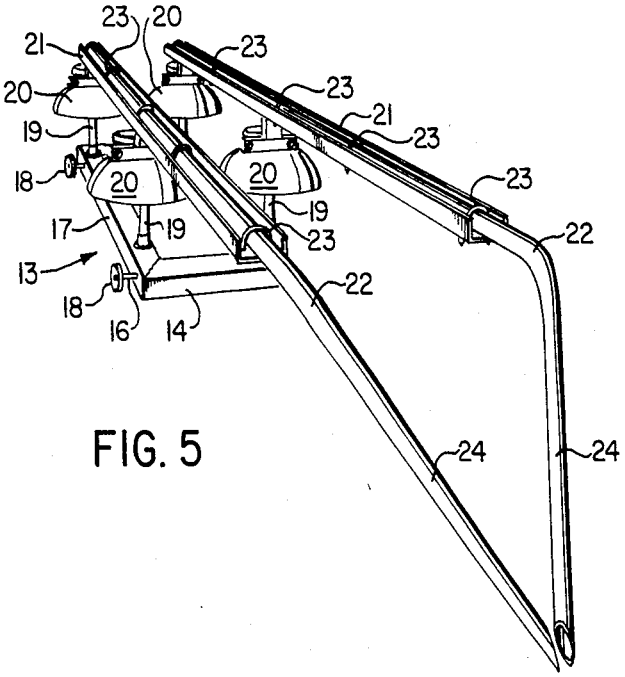
FIG. 5 is a perspective view of the probes of the apparatus of FIGS. 1 to 4.

With reference to FIG. 5, in the preferred form of the invention, each of the probes 22 is defined by an elongated electrically conductive hollow metal body, with a straight bottom end for mounting in the support 21 and on inclined upper end such that when in use, the upper ends 24 of the probes 22 above the support 21 curve inwardly towards the plane of the trolley 13, and towards each other, so that there is only a small gap between the upper ends 24 of the probes 22. As can be seen, the upper ends, or tips of each probe, are obliquely sectioned such that each tip presents in close proximity one to the other, a relatively large air discharge opening, and of course, an elongated elliptical arcing surface.

The first and second trolleys 13 and 14 are interconnected by means of cables 26. Each cable 26 extends between an eye 27 on the bottom end of the trolley 13 and eye 28 on the top end of the trolley 14. Like the trolley 13, the trolley 14 is defined by a rectangular frame 29. A pair of discs 30 is provided on each side 31 of the frame 29 for riding in the tracks 6.

A transformer 33 is mounted on the second trolley 14. Electrical power is fed to the transformer 33 from a source of power (not shown) through a cable 34. A pair of insulators 35 are mounted on posts 36 on the trolley 14 above the transformer 33. Power from the transformer 33 is fed through leads 37 to the probes 22 to cause arcing between the top ends of such probes.

The trolleys 13 and 14 are caused to move up the tracks 6 by a manually operated winch 38 (FIG. 1), which is mounted on the stack 1 beneath the tracks 6. A pair of U-bolts 39 hold the winch body on the stack 1. A cable 40 from the winch drum 41 extends upwardly around a pulley 42 mounted on the stack 1 near the top end thereof. The upper end of the cable 40 is connected by an eye bolt 43 to the frame 15 of the trolley 13. Thus, when the winch 38 is operated, the trolleys 13 and 14 are caused to move upwardly on the stack 1.

Figure 6:
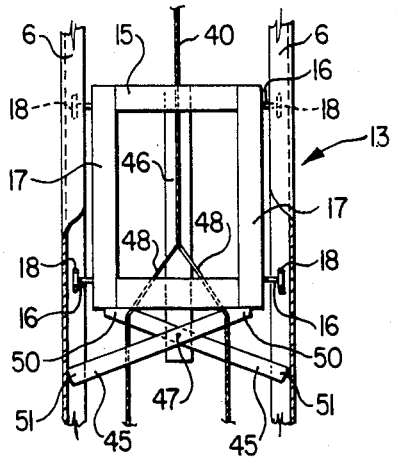
FIG. 6 is a partly sectioned front elevation view of a braking system for use with the ignitor of FIGS. 1 to 5.

While it is not essential to provide a brake for the trolleys 13 and 14, a brake can be provided to prevent damage to the apparatus caused by winch failure. A suitable brake is illustrated in FIG. 6. The brake includes a pair of arms 45 which are pivotally connected to a plate 46 extending downwardly from the bottom of the frame 15 for rotation around a horizontal axis 47. For strength, the plate 46 extends from the top to beyond the bottom of the frame 15. The arms 45 are connected to the plate scissors fashion, i.e. the arms cross each other. One end of each of a pair of cables 48 is connected to the cable 40, and the other end of each cable 48 is connected to one of the arms 45 above the axis 47. Thus, when the cables 40 and 48 are taut during upward movement or locking of the winch 38, the top ends 50 of the arms 45 press against the bottom of the frame 14 to lift or hold the trolley 13. If the cable 40 breaks or the winch 38 fails, the arms 45 rotate around the axis 47, so that the bottom ends 51 of such arms bear against the bight of the tracks 6. By providing a brake shoe (not shown) on the bottom end 51 of each arm 45, braking is improved. Of course, if the trolley 14 is lowered slowly and under control, tension is maintained on the cables 40 and 48, and consequently on the arms 45 to prevent braking.

In operation, with the trolleys 13 and 14 in the lower position, the winch 38 is actuated to move the trolleys up the tracks 6. Upon reaching the top of the tracks 6, the top end of the trolley 13 moves inwardly to position the top ends of the hollow probes 22 substantially centrally over the discharge end of the flare stack 1. High pressure gases, exiting from the discharge end of the stack 1, creates what can loosely be termed a venturi effect around the tips or discharge ends of probes 22, drawing fresh air and hence oxygen through the lower and open inlet ends of the hollow probes 22 to be admixed with the stack gases in the immediate area of the probe tips. Current is then passed through the transformer 33 and the leads 37 to the probes 22 to cause arcing between the arcing surfaces of the probes in the area enriched by the educted supply of fresh air. Such arcing is normally intermittent, i.e. every thirty seconds to ensure ignition of gases. The power source may comprise 12 volt batteries, or in cases where timed ignition is not required, power can be drawn from any external source, for example the operator's truck battery.

It will be appreciated that the use of tracks extending the length of the stack reduces maintenance costs. The probes or electrodes can be lowered for cleaning. Thus, the usual gin pole truck or crane and manbasket are unnecessary. It is also not necessary to lay down the stack or ignitor, or to shut in the well.

Because the hollow probes serve to supply a continuous flow of fresh air and are preferably of stainless steel, an arc can be maintained in adverse weather or sour gas conditions, carbon build-up is greatly reduced and the probes are less susceptible to burn-off.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example equivalent elements may be substituted for those illustrated and described herein, parts may be used independently of the use of other features, all as will be apparent to one skilled in the art after having the benefits of the description of the invention.

What I claim is:

1. A flare stack igniter for igniting gas emitted from a flare stack comprising track means for mounting on a flare stack; trolley means movably mounted on said track means for movement between a rest position at the bottom of the stack and an ignition position at the top of said stack; drive means for moving said trolley means between the rest and ignition positions; probe means carried by said trolley means for igniting said gas; and power means for providing electrical power to said probe means for causing arcing and consequently ignition of said gas; said probe means including a pair of spaced apart probes and insulators supporting said probes on said trolley means, one end of one probe being in close proximity to one end of the other probe to promote arcing between said probes when current is passed therethrough, each said probe including an elongated, hollow, electrically conductive body, said body having inlet means for admitting air into the body and a discharge end for discharging air into the gas whereby the flow of said gas at least in part draws air through the body for promoting combustion of said gas once ignited, each said probe, at its said discharge end, being obliquely sectioned to provide an elongate elliptical arcing surface, said probes being operably positioned such that the arcing surface of one said probe is in close proximity to the arcing surface of the other said probe.

2. A probe for use in a flare stack igniter of the type including a source of electrical power for causing arcing between a pair of probes whereby any combustible gas passing between said probes is ignited, said probe comprising an elongated, hollow, electrically conductive body for conducting electric current, said body including inlet means for admitting air into the body and a discharge end for discharging air into the gas whereby the flow of said gas at least in part draws air through the body for promoting combustion of said gas, said discharge end being obliquely sectioned to provide an elongate elliptical arcing surface and increased air discharge opening.

* * * * *